US006273403B1

(12) United States Patent
Kahlhamer

(10) Patent No.: US 6,273,403 B1
(45) Date of Patent: Aug. 14, 2001

(54) PERFORMANCE CARBURETOR

(76) Inventor: Bruce Roland Kahlhamer, Hwy. 22, P.O. Box 72, Wild Rose, WI (US) 54984

( * ) Notice: Subject to any disclaimer, the term of this patent is extended or adjusted under 35 U.S.C. 154(b) by 0 days.

(21) Appl. No.: 09/394,663

(22) Filed: Sep. 12, 1999

(51) Int. Cl.[7] ..... F02M 9/06
(52) U.S. Cl. ..... 261/44.3; 261/DIG. 38
(58) Field of Search ..... 261/64.1, 66, 78.1, 261/76, 44.3, 44.4, 44.1, DIG. 38

(56) References Cited

U.S. PATENT DOCUMENTS 1,151,578 * 8/1915 Entz ..... 261/44.3
1,444,222 * 2/1923 Trego ..... 261/44.3 X
3,985,839 * 10/1976 Edmonston ..... 261/DIG. 38
4,013,741 * 3/1977 Edmonston ..... 261/44.3
4,185,054 * 1/1980 Nakamura et al. ..... 261/44.4
4,221,747 * 9/1980 Edmonston ..... 261/DIG. 38
4,524,034 * 6/1985 Ellison ..... 261/44.3 X
4,971,730 * 11/1990 Edmonston ..... 261/44.3
5,021,198 * 6/1991 Bostelmann ..... 261/44.3
5,258,143 * 11/1993 Wang ..... 261/44.3
5,300,259 * 4/1994 Tashiro ..... 261/78.1 X
5,342,555 * 8/1994 Edmonston ..... 261/78.1 X
5,662,836 * 9/1997 Yost ..... 261/DIG. 38

* cited by examiner

*Primary Examiner*—Richard L. Chiesa
(74) *Attorney, Agent, or Firm*—Loyd W. Bonneville

(57) ABSTRACT

A carburetor having four distinct features providing improved performance: A sculptured chamber having a D-shaped configuration; a fuel flow interference needle with a number of bevel zones; easily accessible needle advancement and retraction means; and a centrally disposed auxiliary fuel jet aperture emission site.

14 Claims, 4 Drawing Sheets

FIG 5
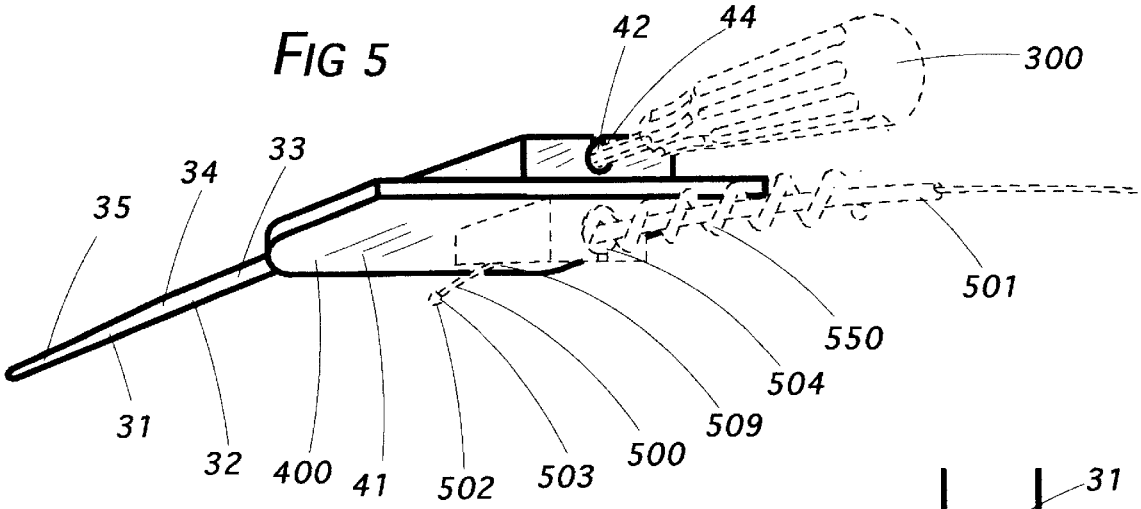
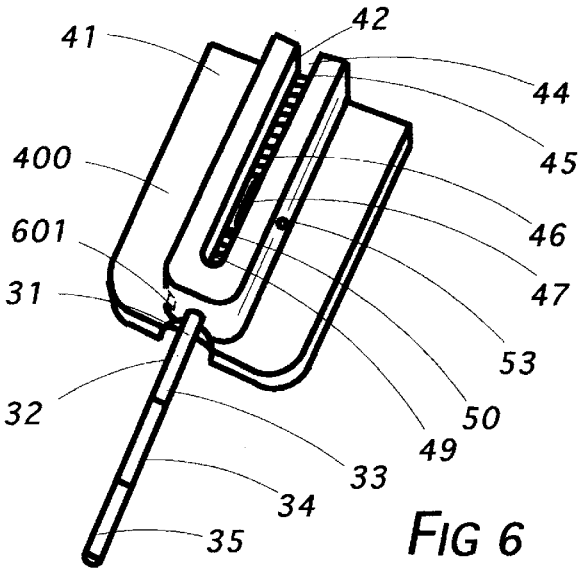
FIG 6
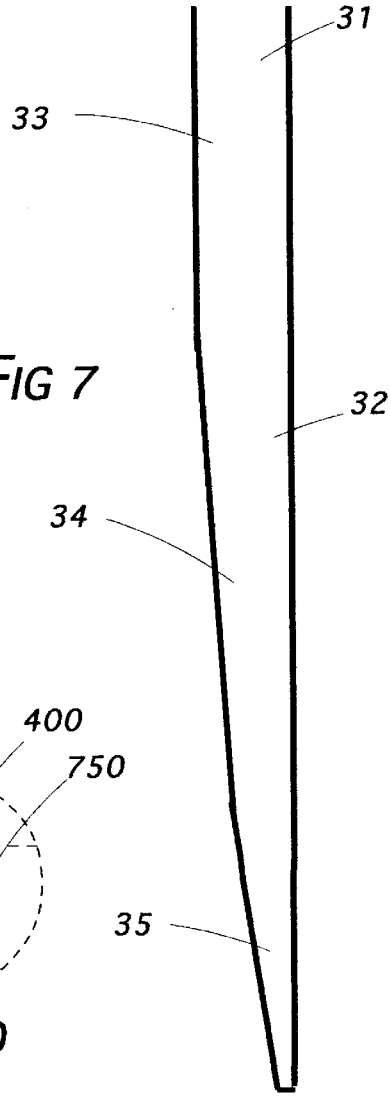
FIG 7
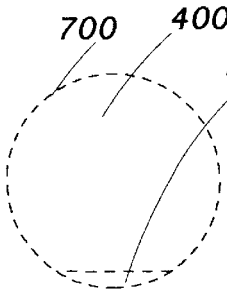
FIG 8
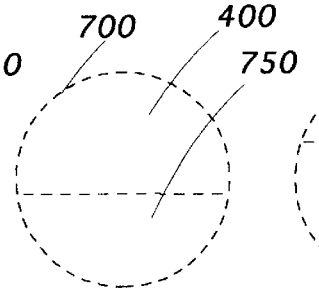
FIG 9
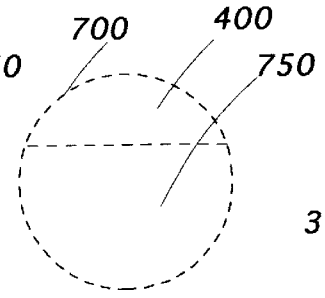
FIG 10

PERFORMANCE CARBURETOR

BACKGROUND OF THE INVENTION

1. Field of the Invention

Combustion engine accessories

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term fuel flow interference needle (31) might be used in one instance but in another, if meaning is otherwise clear from context, expression might be shortened to interference needle (31) or merely needle (31). Any of those forms is intended to convey the same meaning. The term attach or fasten or any of their forms when so used means that the juncture is of a more or less permanent nature, such as might be accomplished by nails, screws, welds or adhesives. Thus it is stated herein that the frontal chamber complement (4), where threaded bolts are employed for the purpose, is attached to the rear chamber complement (5). A connection in which one object is easily removed from another is described by the word emplace, as where it is stated herein that an object comprising operable adjustment means (300) employed for needle advancement and retraction is emplaced in the tunnel (42) to turn a threaded adjusting block (46). Employment of the words connect or join or any of their forms is intended to include the meaning of both in a more general way.

The term rigid emplacement denotes a connection other than by attachment which, nevertheless, permits separation only with great difficulty or torturous manipulation. It is accordingly stated herein that the anchoring of the knurled throttling cable end (503) within the cable end trap (509) is a connection of rigid emplacement.

The word multiply is not used herein as a verb, as often otherwise employed, but rather, as an adjective. Thus, where it is stated that carburetion is controlled in part by needling fuel jet (800) penetration by a multiply beveled fuel flow interference needle (31), meaning that more than one beveled area is present thereon (31).

The word comprise may be construed in either of two ways herein. A generic term used to describe a given one of a number of specific elements is said to comprise it, thereby characterizing the specific element with equivalency in meaning for the generic term. Thus, throttling cable anchoring means (502) may be said to comprise a knurled end (503), meaning that in the particular case, the means (502) is such an end (503). However, the word comprise may also be used to describe a feature which is part of the structure or composition of a given element. Thus, a carburetor chamber (1) may be said to comprise D-shaped configuration (2), meaning that the structure of the chamber (1) is such as to have the D-shape (2) as a feature of its structure. The meaning in the respective cases is clear from context, however. Accordingly, modifying words to clarify which of the two uses is the intended one seem unnecessary.

Terms relating to physical orientation such as up, down, higher and lower refer to carburetion assembly positioning in the manner in which it is typically mounted in a vehicle and consistent with the manner the subjects of this application are shown in the drawings. Thus, the throttling gate (41) is frequently spoken of as being raised or lowered and portions of the chamber (1) are referred to as the top or bottom thereof (1).

The terms effectually open and effectually closed are used herein with reference to adjustments in height of the throttling gate (41). The gate (41) is stated herein to effectually open and effectually close the chamber (1). The use of such terminology acknowledges the fact that even when the gate (41) is brought to its (41) lowest point within the chamber (1), a small opening necessary to allow the flow of sufficient air for engine idling remains. Although the chamber's (1) closure may not, therefore, be complete, it may correctly be said to be effectually so. Conversely, although the gate (41) may have not been brought completely to the top of the chamber (1) upon throttling cable (500) retraction, maximum airflow may, nevertheless, have been attained. At that height, the gate (41) is stated herein to be effectually open.

Although carburetion has been known since the last century, the never ending search for better efficiency and improved performance continues today.

The historical development of the Venturi principle—establishing that air speeds up when passed through a portion of a duct which has been narrowed—has led to the sculpting of carburetion chambers so as to confer upon the walls thereof the convexity which will accommodate the principle. Despite that and other redesign undertakings, however, carburetion problems remain. Despite the expectation that performance should increase proportionately to operable throttle advance, it has been observed that the rate of increase levels off or even drops when engine throttling is taken to the higher range. In stressed circumstances such as mountain driving where the air is thinner, carburetion problems become aggravated. Acquiring a larger carburetor to address them unfortunately results in a tradeoff at mid and lower range carburetion levels.

Typically, carburetors comprise a sliding mechanism—an airflow obstructor (400)—controlled operationally by retraction or extension of a throttling cable (500). The cable (500) is configured with anchoring means (502), discussed further ante, so that when retracted, the the airflow obstructor (400) is tugged open to allow therethrough the passage of air. The mixture of air and fuel is ducted to the engine's combustion chambers.

To reduce airflow and accordingly, fuel combustion, the sliding obstructor (400) is allowed effectually to close off or restrict airflow. That is accomplished by a gate spring (550) which upon expansion, forces the obstructor (400) across the carburetor chamber. Thus, the obstructor (400) is biased closed and continual operator effort or tethering means of some sort is required to keep the chamber open.

When effectually closed, the movable obstructor (400) is generally configured to permit the passage of a smaller volume of air, an amount just sufficient to support engine idling.

The fuel enters the chamber through one or more fuel jets. As the air passes through the chamber it creates a partial vacuum—particularly in a sector thereof (701) configured with Venturi convexity—which at a given level draws the fuel along with it.

It is generally recognized that carburetors comprise performance characteristics ranging from low level to high level, corresponding with cross sectional airflow access area (750) causally associated with throttling cable (500) disposition ranging from idling status to full retraction.

An examination of a typical chamber from either of its ends, discloses that as the throttling cable (500) is retracted, effectually opening the sliding or otherwise movable obstructor (400), the cross sectional carburetor airflow access area (750) is enlarged and engine performance is enhanced. Additional throttle retraction increases that area (750) even more but once the obstructor (400) is effectually opened, being raised to a point beyond half way, the increase in engine performance becomes negligible and fails to correspond proportionately with the increased volume of carbureted air.

This effect is often taken for granted by vehicle operators and considered merely to be a limitation inherent in the engine. A crucial factor, however, lies in the fact that the shape of the chamber itself—more or less symmetrically tubular—presents an airflow access area (750) which enlarges only a very small amount as the airflow obstructor (400) effectually opens a considerable amount.

One may readily visualize this by observing the curvature or arcuitry of the top of the circle circumferentially describing the area (750). While the sliding obstructor (400) moves along a linear continuum as it (400) is effectually raised or opened, the uppermost portion of the circular airflow access area (750) increases only slightly and the rate of increase diminishes with every progression.

Seen this way, it should be readily recognized that as the sliding obstructor (400) is raised from an effectually closed position, exposing the bottom of the circular area (750), a small upward displacement of the obstructor (400) enlarges the circular area (750) considerably and the circularity or arcuitry widens. This phenomena necessarily occurs until the sliding obstructor (400) reaches the circle's half way point. The shaping of the carburetor chamber must, therefore, address more than that provided by Venturi convexity (701). The challenge is to alter in some manner the existing phenomena. It is for this reason that the sculpting of the chamber can become a fascinating endeavor.

In sports vehicles—snowmobiles and speedboats, for example—carburetor designs providing not only for constancy of efficiency at all carburetion stages but as well for quick acceleration response throughout all levels of operation are constantly sought after. Operational readjustments may be made, of course, to accommodate the problems as they arise during vehicle use. It is not an uncommon experience for an operator to contend with sluggish performance by spending 20 minutes resetting or retuning the carburetor by disassembling and adjusting parts which are virtually inaccessible. The task with snowmobiles is complicated by adverse winter conditions and with boats by buoyant instability upon the water. If attempted with a snowmobile in a remote area, as it sometimes is, the loss even one of the tiny components can be disastrous.

Laboratory tests demonstrate that conventional prior art combustion is generally incomplete. When seen during operation under strobe light observation, droplets of fuel are readily apparent in the carburetion chamber. It is widely recognized that a more complete atomization of the fuel provides a better mix with the air which, carried to the combustion chamber, enhances explosive power. Despite the several decades of carburetor development undertaken, no model has previously emerged which provides the strobed mist or cloud sans droplets in the carburetion chamber.

Engine performance for its own sake is obviously an important issue. Nonetheless, there are few things more exciting in sports vehicle operation than the quick burst of response one achieves from a carburetor of improved design; and there are few disappointments which exceed those experienced when such performance is absent. Unfortunately, as the fuel flow interference needle known to prior art is withdrawn from the needling fuel jet (800), the change in performance observed seems merely lackluster. Previous embodiments fail to provide the excitement experienced operating an engine which virtually leaps into a higher power stage. Characterizing the challenge presented, it would be particularly gratifying to create an interference needle which is shaped to confer these more or less sudden carburetion shifts.

If these needs for discontinuous stage-to-stage carburetion and enhanced proportional carburetion efficiency together could be addressed by reshaping the interference needle and reshaping the chamber, many types of sports vehicles as well as other engine operated devices could be made more saleable.

The needs or objectives pointed out supra thus far remain only partly addressed in the prior art. Some, such as that just immediately addressed, have not been met at all.

SUMMARY OF THE INVENTION

The invention is a carburetor comprising as distinct features providing improved performance: A sculpted chamber comprising Dshaped configuration (2); a multiply beveled fuel flow interference needle (31) in which the bevel zones (33, 34, 35) offer discontinuous levels of engine performance; easily accessible needle advancement and retraction adjustment means (42, 44—51 and 53); and a centrally disposed auxiliary fuel jet aperture emission site (10).

The sculpted D-shaped chamber configuration (2) enlarges carburetor airflow access area (750) at the top of the chamber (1) permitting a larger volume of airflow therethrough (1) and providing improved performance to throttling cable retraction correspondence at the higher carburetion levels. To form the D-shape (2), extremity hollows (9) are carved into the chamber's (7) Venturi convexity (701).

The multiply beveled fuel flow interference needle (31) comprises bevels (33, 34, 35) which, upon engagement with the needling fuel jet (800), present discontinuous performance levels in a sequential manner such that the operator of a sports vehicle experiences exciting acceleration bursts or jumps.

The needle advancement and retraction means (42, 44—51 and 35) simplify access to and adjustment of the position of the multiply beveled fuel flow interference needle (31) with reference to the needling fuel jet (800), an otherwise laborious and time consuming task at prior art.

The central disposition of the auxiliary fuel jet aperture emission site (10) provides an improved carburetion mix of fuel and air observed under testing conditions to eliminate fuel droplet formation therein. The site (10) provides that fuel emission from a fuel jet (850) auxiliary to that issuing from the needling jet (800) be emitted at a point much nearer the engine's combustion chamber than in prior art models, thereby delivering an improved flow of carbureted air thereto.

These features, working in conjunction with one another dramatically enhance engine performance for all engines in general and provide, in particular, excitement for operators of sports vehicles.

BRIEF DESCRIPTION OF THE DRAWINGS

Solid lines in the drawings represent the invention. Dashed lines represent either noninventive material; that not incorporated into an inventive combination hereof; or that which although so incorporated, lies beyond the focus of attention.

FIGS 3–6 comprise views of the carburetion adjusting assembly, illustrating the throttling gate (41), multiply beveled fuel flow interference needle (31), the needle advancement and retraction tunnel (42) and other elements thereof.

FIG. 7 depicts the multiply beveled fuel flow interference needle (31), pointing out with particularity three bevel zones (33, 34, 35) thereof (31).

FIGS. 8–10 comprise symbolic representations of three separate states of the carburetor airflow access area (750), each related to the positioning of an airflow obstructor (400) within the typical carburetor chamber existent in prior art. The first of those three, FIG. 8, illustrates an effectually closed position in which a small carburetor airflow access area (750) exists, providing carburetion sufficient only for idling. FIG. 9 indicates an intermediate level at which increasing carburetion efficiency still occurs as the sliding obstructor (400) is further opened. The last of the three, FIG. 10—in which the obstructor (400) has reached the half way point—illustrates the level at which near maximum carburetion efficiency is attainable.

DESCRIPTION OF THE PREFERRED EMBODIMENT

The subject of this application is a carburetor comprising performance improving features provided by innovations revealed herein which, working in conjunction with one another, achieve startling results.

Figure 2:
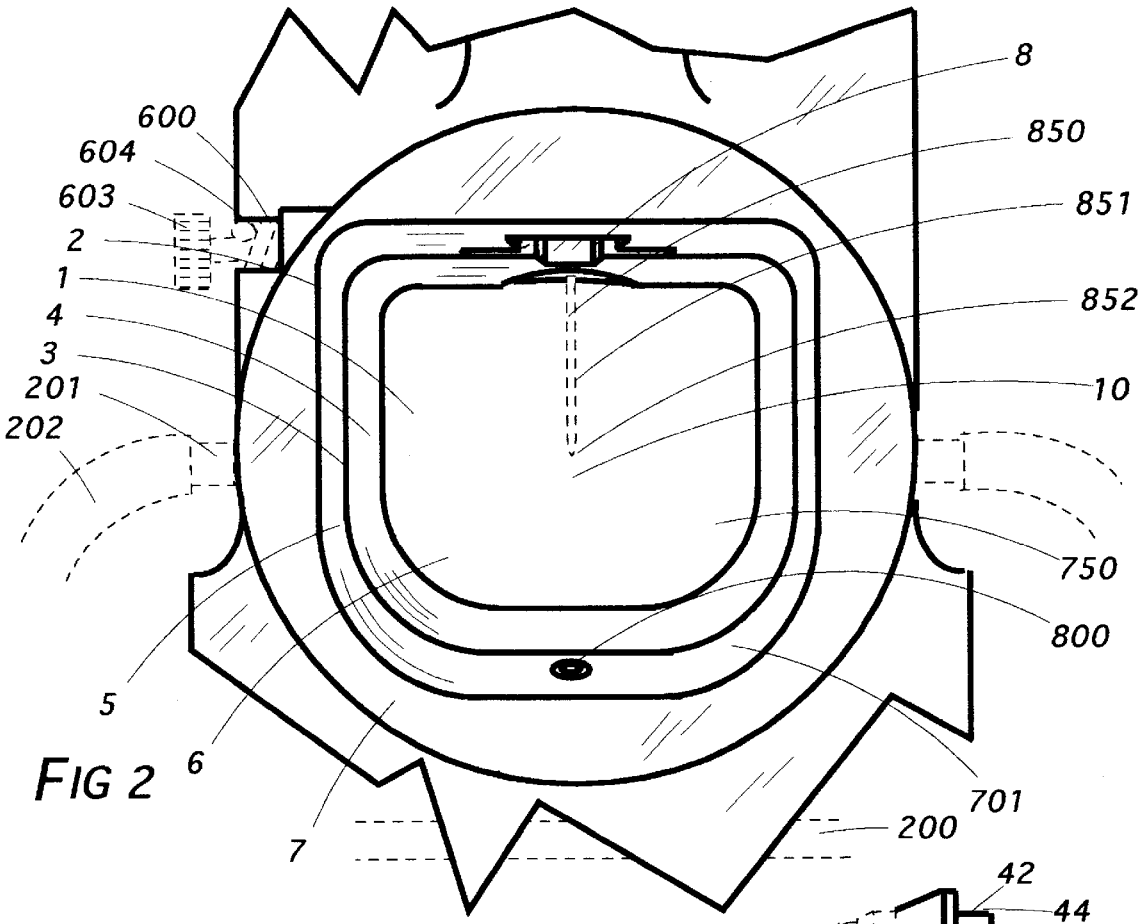
FIG. 2 represents a view of the chamber (1) from the invention's intake end (6) more clearly showing the chamber's D-shaped configuration (2) feature.

The invention features a carbureting chamber (1) which, as shown most clearly in FIG. 2, comprises D-shaped configuration (2). The meaning of that term is intended to suggest in part that the circular cross section of the chamber known to prior art is truncated herein so that the cross sectional shape is like that of the letter D turned sideways with the flat portion thereof at the top.

It is already recognized, of course, that the chamber, whether of prior art or the one disclosed herein (1) comprises a wall deliberately made convex (701) in emulation of the Venturi curve present in a tubular inner restriction. That curvature (701) runs essentially from the chamber's air intake end (6) most or all of the way to its opposing effluxive end (7)—the end from which carbureted air is discharged enroute to the engine's combustion chamber. The construction, therefore, may be considered a longitudinal one.

Merely truncating the cross sectional circularity of a prior art chamber, however, would result in partial loss of otherwise useful cross sectional airflow access area (750). instead, the sculpting is accomplished such that the height of the area (750) is retained. In conferring the D-shape (2) upon the chamber (1), therefore, chamber extremity hollows (9), such as those shown in FIGS. 1 and 2, are carved into it (1). such that portions of the longitudinal convex shaping (701) are removed.

The D-shaped carbureting chamber (1) may be considered an independent improvement upon a carburetor in its own right. By reason of its (1) configuration, high level carburetion is proportionately enhanced at full throttling cable (500) retraction.

Figure 1:
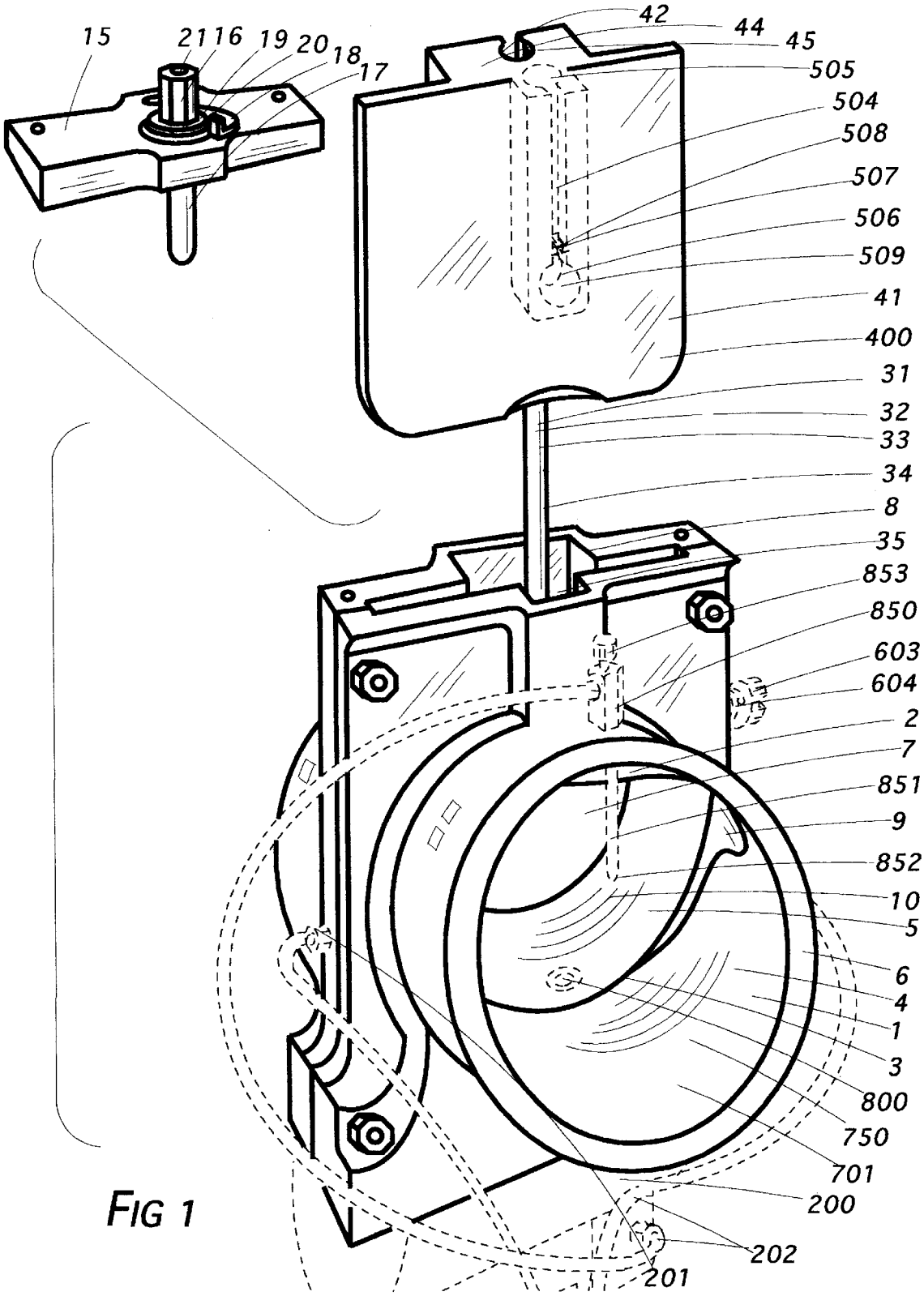
FIG. 1 depicts a perspective exploded view of an embodiment of the invention in which the throttling gate (41) and carburetor manifold cover (15) and related accessories are separated from the main body.

Preferably, the carburetor also comprises a separation seam (3), shown in FIGS. 1 and 2, which joins a frontal chamber complement (4) to a rear chamber complement (5). This cleavage simplifies manufacture and repair. These two parts (4, 5), when present, are attached merely with bolts which may be unscrewed to access the interior of the structure.

The invention further comprises a carburetion adjusting assembly comprising a throttling gate (41), a throttling cable (500) disposed within a cable sheath (501), a coiled gate spring (550), a multiply beveled fuel flow interference needle (31) and a threaded adjusting block (46).

The carburetion adjusting assembly addresses the control desired both concerning the effectual size and configuration of the carburetor cross sectional airflow access area (750) and the amount of fuel permitted to enter the carburetion chamber (1) from what is well recognized at prior art as the carburetor float assembly (200). While the D-shaped configuration (2) provides the chamber (1) with a substantial maximum airflow access area (750), only a fraction thereof (750) is generally desired at midrange and low levels of carburetion.

As mentioned, supra, the additional cross sectional area (750) made available at the top of the chamber (1) by reason of the D-shape (2) is required to attain performance gain proportional to throttling cable (500) retraction at the highest level of carburetion. Thus, when the airflow area (750) is small as it is for engine idling, the chamber hollows (9) conferring, as it were, corners upon an otherwise rounded configuration, play no role in airflow control.

The throttling gate(41) is depicted in various views in FIGS. 1 and 3–6. This structure (41) behaves like a sliding door, seated in the carburetor's gate sliding channel (8) as it (41) is. It (41) is activated upwards in the channel (8) by retraction of the throttling cable (500). Appropriate adjustments are made in manufacture so that when full throttle retraction occurs, the gate (41) is pulled upwards within the channel (8) and, therefore, also the chamber (1), to the point the highest level of carburetion is achieved.

When the throttling gate (41) is released upon ceasing to retract the throttling cable (500), ante, one cannot rely merely upon gravity to effectually close it (41). Rather, expansion of the coiled gate spring (550) accomplishes that task.

The spring (550) is housed in a gate spring receiving tunnel(504) disposed within the throttling gate (41) and shown in FIGS. 1 and 5. When the throttling cable (500) is retracted, as further explained ante, it (500) pulls the gate (41) upward with it (500). This movement contracts the spring (550) against a manifold cover (15), ante, disposed by attachment at the top of the gate sliding channel (8). The tunnel (504) is oriented so that the spring (550) expands against the floor thereof (507), forcing the gate (41) in the direction of expansion. Upon release of the throttling cable (500), the spring (550) is allowed to expand, restrained at its (550) upward end against the immobile cover (15) and, by reason of exertion against the tunnel's floor (507), push the mobile gate (41) down the gate sliding channel (8).

The throttling cable (500) is an additional component of the carburetion adjusting assembly. Although in an automobile, it is activated by depression of a foot pedal, in sporting vehicles this function is accomplished by squeezing a handgrip lever, rotating a handgrip sleeve or otherwise manipulating a hand operated control. The manual effort withdraws or retracts the cable (500) from an engine empowering mechanism at its (500) other end—in a snowmobile and similar vehicle, from the carburetion assembly.

However, herein as at prior art, the throttling cable (500) is connected to the throttling gate (41), supra, of the carburetor which it (500) retracts along with itself (500). In order to accomplish this task, the cable (500) is connected to the gate (41). For that purpose, it (500) is inserted into an external gate spring tunnel port (505), through the tunnel (504), supra, and a tunnel floor slot (508), ante, and caused to exit an internal gate spring tunnel port (506). The connection is made by comprising the carburetor end of the cable (500) with anchoring means (502) preferably comprising a knurled end (503), providing the end (502) with knot-like configuration so that as the cable (500) is withdrawn, the knurled end (503) is brought against a barrier within the gate (41) so that it (500) cannot slip through or work loose.

Herein, as at prior art, the construction of the knurled end (503), the gate receiving tunnel (504) and related portions of the gate (41) is such as to impede further movement of the cable (500) without drawing the throttling gate (41) along with it (500). The throttling cable (500) is strung through the gate spring (550). It (500) continues, however, beyond the floor (507) of the gate spring receiving tunnel (504) via a slot (508) in the floor thereof (507) through which it (500) is strung, terminating in a cable end trap (509) just below the tunnel (504). The knurled end (503), when employed as cable anchoring means (502), comprises size such that it cannot pass through the slot (508) in the tunnel floor (507). The connection, therefore, comprises one of rigid emplacement, as that term is employed herein.

Figure 11:
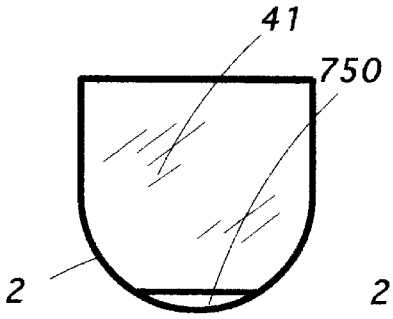
FIGS. 11–13 symbolically comprise three corresponding states of the carburetor airflow access area (750) within a carburetor configured to comprise a Dshaped chamber (2).

To achieve a small cross sectional airflow area (750), effectually closing the chamber (1), it is merely necessary to allow the gate spring (550) to force the throttling gate (41) to or proximate the bottom of the chamber (1). It should be readily apparent from FIGS. 1 and 4 that by reason of the small curvature shown at the bottom of the throttling gate (41), some air will be allowed to pass through. This diminished flow is sufficient to maintain engine operation at idling level. The relative size of the airflow area (750) is symbolically represented in FIG. 11.

Figure 12:
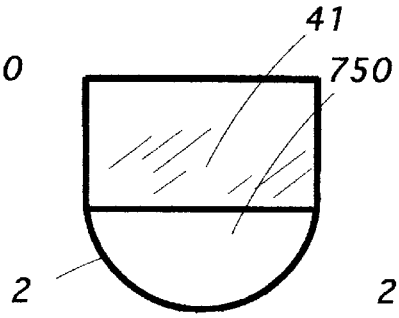

To enlarge the cross sectional airflow area (750), the gate (41) need be raised only a moderate distance. This is accomplished by manipulating the hand control slightly and thereby retracting the throttling cable (500) a small distance. The cross sectional area (750) is shown symbolically for comparison in FIG. 12.

Figure 13:
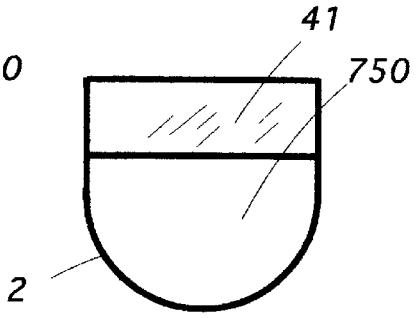

To effectually open the chamber, thereby enlarging the cross sectional airflow area (750) even more, the throttling cable (500) is retracted to a point at or proximate the maximum. Airflow area (750) becomes that depicted symbolically in FIG. 13.

The throttling cable (500) is disposed within a cable sheath (501) such that it (500) moves freely therein (501). The sheath (501) protects the cable (500) from damage which might otherwise result from rust or dirt. In order to prevent the sheath (501) from moving along with the cable (500) when retracted, it (501) is attached to a throttling cable access nut (16), ante, disposed atop a carburetor manifold cover (15), described ante. In the embodiment featured herein, attachment is accomplished by interthreading the two (501, 16, respectively).

The carburetion adjusting assembly further comprises a multiply beveled interference needle (31) and a needling fuel jet (800).

The interference needle (31) comprises a shank (32) which projects in elongation from the throttling gate (41) and penetrates or protrudes into the needling fuel jet (800) disposed at the bottom of the chamber (1). The carburetion adjusting assembly further comprises what may be characterized in the generic sense as needle retention means which anchor the needle (31) and thereby permit adjustment of its (31) position by means of appropriate manipulations within the tunnel (42). Accordingly, the interference needle (31) comprises a stop (50) and, preferably, a spacing spring shoulder (51) atop which the stop (50) is disposed.

The tunnel (42) comprises a readily accessible external port (44) through which, with the aid of an appropriate but simple tool, operable adjustments regulating the depth of needle (31) protrusion into the needling fuel jet (800) are undertaken. By reason of such configuration, it is unnecessary to disassemble the carburetor to make a performance adjustment as is the case at prior art.

Preferably, for reasons explained ante, the needling fuel jet (800), an article well known in the art, should be disposed as near the chamber's effluxive end (7) as is feasible.

To accommodate the interference needle (31), the throttling gate (41), supra, further comprises a threaded needle advancement and retraction adjusting tunnel (42), a threaded adjusting block (46) and spring loaded block lugs (48) disposed in the tunnel (42). The tunnel (42) comprises an external port (44) through which adjustment access is provided.

Both the stop (50) and spacing spring shoulder (51), if present, supra, are disposed within the adjusting tunnel (42), the needle stop (50) atop the shoulder (51), which in turn is preferably but not necessarily enwrapped by a needle spacing spring (49).

Figure 3:
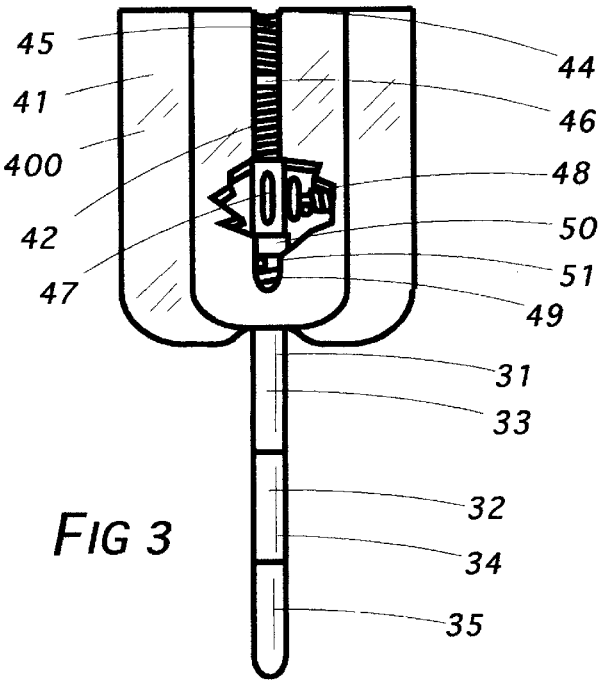

The threaded adjusting block (46), supra, comprises adjusting block grooved detents (47) disposed therein as shown in FIG. 3. In that embodiment, the detents (47) are configured in the manner of longitudinal grooves.

Operable adjustment means (300) are employed to advance or retract the needle (31) so as to extend more or less of the shank (35) from the throttling gate (41). Preferably, the adjusting block (46) is configured to accommodate turning by a screwdriver comprising a small hexagonal tip emplaced within the tunnel (42) for the purpose, an example of well recognized operable adjustment means (300).

As adjustment is made, the threads of the adjusting block (46) engage those (45) of the adjusting tunnel (42). As the block (46) turns, the detents (47) disposed therein (46) are engaged by the spring loaded block lugs (48) disposed within the tunnel (42) adjacent to the block (46). Each lug (48) is configured to just fit each detent (47) such that they snap into place with an audible click as the block (46) is turned. Although the fit is snug, sufficient play remains to allow further turning of the threaded block (46). This feature provides a satisfactory adjustment technique since the operator may make an adjustment merely by selecting the number of clicks he or she elects to hear. Each detent (47) is disposed upon the adjustment block (46) circumferentially at fractional turn intervals. Preferably, the number of detents is four, thereby permitting one-quarter turn adjustments at a time.

The throttling gate (41) additionally comprises means for retaining the block lugs (48) in place. Preferably, such means comprise a lug assembly set screw (53), a small fastener disposed upon the throttling gate (41) disposed for access by a small screwdriver.

As the name suggests, the multiply beveled fuel flow interference needle (31) comprises a plurality of bevels (33, 34, 35). Preferably, the number thereof equals three. The bevels configure the shank (32) such that while it (32) becomes longitudinally tapered with flatness as known in prior art, the number of flat zones comprises more than one.

It must be first understood in this connection that the interference needle (31) penetrates the needling fuel jet (800). It is well known that a tapered needle (31), the smallest diameter thereof disposed at the tip, limits the amount of fuel emitted from the jet (800) as it penetrates more deeply. Thus, in normal operation, as the throttling cable (500) is retracted and the throttling gate (41) withdrawn from the carbureting chamber (1, the needle (31), connected to the throttling gate (41) as it is, is also withdrawn from the needling jet (800). A larger volume of both air and fuel are, therefore, drawn through the chamber (1) and engine performance increases.

If the needle (31) is tapered continuously at the same slope, as is the case for some embodiments in prior art, levels of performance are attained along a gradient. A multiply beveled needle (31) such as that shown in FIG. 7 results in a degree of discontinuity between levels of performance, exhibiting successive bursts or jumps from one level to another. If the number of bevels is three, as preferred and illustrated in FIG. 7, the needle bevel zones may be characterized as proximal (33), intermediate (34) and distal (35), the latter (35) being disposed nearest the tip. The respective zones (33, 34, 35) are identified in FIG. 7.

Figure 14:
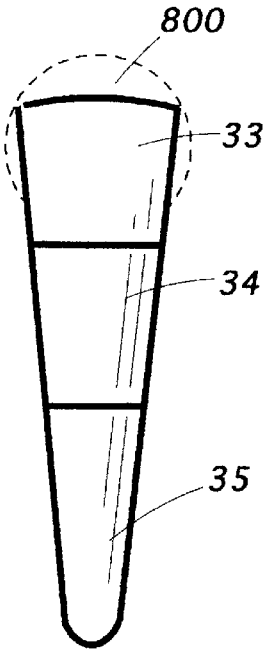
FIGS. 14–16 symbolize three penetration states within the needling fuel jet (800) described by a three zone (33, 34, 35) embodiment of the multiply beveled fuel flow interference needle (31).
Figure 15:
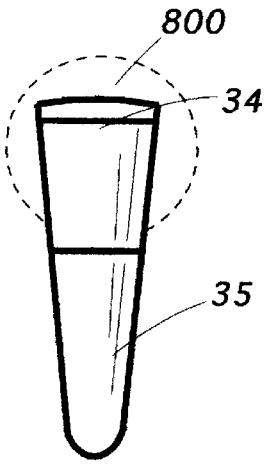
Figure 16:
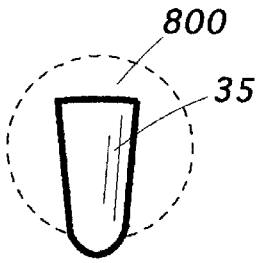

A beveled needle (31) may be formed by grinding an elongated cylindrical body or by some other method of manufacture, depending upon the material employed. The angles between the successive planes or zones (33, 34, 35) is subtle, barely noticeable upon cursory examination. However, experience demonstrates that the performance of the needling fuel jet (800) is markedly changed with each zone (33, 34, 35) shift. FIGS. 14–16 illustrate the area changes at the mouth of the needling jet (800) upon the needle's (31) withdrawal of the respective zones (33, 34, 35) from it (800).

Two events occur as a result of these changes. First, cross sectional area is rapidly changed at the mouth of the jet (800) with transition from one zone (33, 34, 35) to another (33, 34, 35). Second, with the passage of each zone (33, 34, 35), the volume of space occupied within the jet (800) also changes rapidly. It would appear that both of those events working in conjunction with one another affect fuel flow in a somewhat discontinuous manner. Experience demonstrates, however, that the zone (33, 34, 35) transition changes occur suddenly and that performance changes correspondingly as a result.

Thus, as the needle shank (32) lies substantially within the jet (800), a circumstance in which the proximal zone (33), the one offering the greatest interference to fuel flow, is one of those (33, 34, 35) which repose therein (800)—the circumstance which exists when the throttling gate (41) is effectually closed—the bulk of the needle (31) lies within the jet (800) through which the fuel is drawn. As the needle (31) is withdrawn sufficiently, the proximal zone (33) no longer reposes within the jet (800) but the intermediate zone (34) is among those (34, 35) which do. That zone (34) offers some interference to fuel flow but less than the proximal one (33) did. Concurrently, the throttling gate (41) is raised to an intermediate level. As the intermediate zone (34) is next withdrawn, only the distal one (35) remains, offering the least interference of all. The multiply beveled fuel flow interference needle (31), thus comprises means whereby sequential performance levels are made to correspond with the respective bevel zones (33, 34, 35) present in the needling jet (800). In view of the sequential exposure to the various levels, as opposed to the single one, engine performance is expressed in correlated sequential discontinuity. As an independent feature, therefore, the multiply beveled needle (31) may properly be considered an improvement to a carburetor in its (31) own right.

Thus, with the retraction of the throttling cable (500) and the progressive withdrawal of the needle (31) from the needling jet (800), the sports vehicle operator is provided exciting bursts of performance consistent with the respective zone levels (33, 34, 35).

It is widely recognized that fuel may be supplied to the carburetion chamber (1) through more than one route. Preferably, the carburetor additionally comprises an auxiliary fuel jet (850) which, in conjunction with the needling jet (800) provides a more manageable fuel supply.

The auxiliary jet (850) is disposed within the chamber (1) preferably in opposition to the needling fuel jet (800). Since the latter (800) is disposed in the bottom of the chamber (1) to facilitate engagement by the multiply beveled fuel flow interference needle (31), the former (850) is preferably disposed at the top of the chamber (1). Where the needling jet (800) is disposed, as preferred, in the rear chamber complement (5)—nearer the chamber's effluxive end (7)—the auxiliary jet (850) is preferably disposed in the frontal chamber complement (4). Such opposition in placement balances and maximizes dispersal of fuel emission within the chamber (1).

As was sometimes the case at prior art, the auxiliary jet (850), when present, preferably comprises an auxiliary jet tube (851) disposed to project into the chamber (700), comprising at its (851) end an emission aperture (852). In departure from prior art, however, the aperture (852) is disposed at a central aperture emission site (10). The reference to central designates the site's (10) position with reference to the chamber (700) in both the longitudinal and cross sectional sense. The aperture (852) is disposed, longitudinally speaking, in the frontal chamber complement (4) in the general proximity of other structures therein which control air inflow, such as an airflow obstructor (400). With reference to a cross section of the chamber (700), the site (10) is disposed proximate the center thereof (700). The terms central or centrally disposed, when applied to the aperture emission site (10), refers to both of those dimensional aspects.

As at prior art, the auxiliary fuel jet (850) further comprises an adjustment screw (852) providing setting means of controlling the rate of fuel inflow. It is preferable that the screw (852) comprise a slotted head so that adjustment be made by a simple screwdriver.

Where an auxiliary fuel jet (850) is present, the invention must further comprise, as it does in prior art, vent tubing (202) to transfer fuel from the carburetion float assembly (200) to the fuel jet (850).

The invention also comprises the engine idle tuning assembly (600). Well recognized as it (600) is at prior art and because it (600) relates to the invention only incidentally or indirectly, no inventive features are claimed herein with reference to it (600). In FIGS. 1 and 2, the assembly (600) is shown to comprise a tuning screw (603) and tuning screw spacing spring (604).

Figure 4:
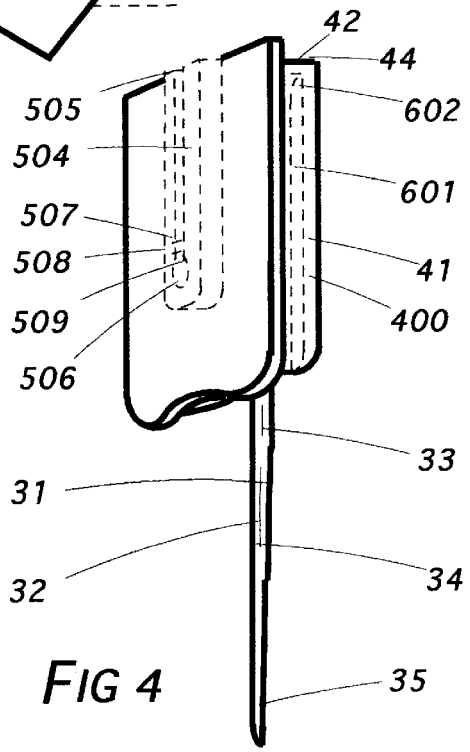

To accommodate idling adjustments, FIG. 4 shows the throttling gate (41) configured to comprise a tuning screw receptacle channel (607), comprising in turn an impingement zone (602). As at prior art, the tuning screw (603) engages the impingement zone (602) of the receptacle channel (607). The impingement zone (602) comprises a sector of the channel (601) which is curved in configuration, the curvature oriented toward the tuning screw (603) in a concave manner. When the throttling mechanism is effectually closed, the tip of the screw (603) rests against the top of the concave curve of the impingement zone (602). As the screw (603) is tightened by turning, its (603) tip, following a path of diminished resistance, seeks a deeper part of the concavity. In so doing, the receptacle channel (601) and the throttling mechanism comprising it (601) is forced slightly upward. Further tightening results in raising the mechanism even further until the tip of the screw (603) reaches the bottom of the impingement curve. As the throttling mechanism is raised, airflow through the carburetion chamber (1) increases.

The carburetor as known to prior art comprises a carburetion float assembly (200) which functions automatically much in the manner of the familiar manual toilet flush. It (200) comprises a reservoir from which fuel is ducted through jets (800, 850) to the chamber.

It is preferable that the carburetor comprise vent tubing (202) providing the carburetor float reservoir with air comprising atmospheric pressure.

The manifold cover assembly of the improved carburetor preferably comprises additionally a manifold cover (15), a throttling cable access nut (16), a pivotable adjusting tunnel barrier (18) and intermediate barrier securing means (19) disposed to overlie the barrier (18).

The manifold cover (15) comprises plate-like configuration and is disposed by attachment to overlie the gate sliding channel (8). The pivotable adjusting tunnel barrier (18) comprised by the manifold assembly, shown in FIG. 1, is operably disposed to pivot so as to overlie the needle advancement and retraction adjusting tunnel (42). The tunnel barrier (18) is preferably shaped, as illustrated, so that it can be made to pivot by manually pushing against a portion thereof (18). The intermediate barrier securing means (19) also comprised by the assembly is disposed to overlie the pivotable barrier (18) and prevent it from becoming easily dislodged from its position when covering the adjusting tunnel (42). Preferably, the intermediate barrier securing means (19) comprises a compression washer (20), a suitable object to accomplish that task.

Positioned as it is, the manifold cover (15) also overlies the needle advancement and retraction adjusting tunnel (42) and the gate spring receiving tunnel (504). In order to allow those tunnels (42, 504) to remain unobstructed so as to accomplish their respective purposes, the cover (15) additionally comprises openings disposed in alignment with them (42, 504).

The throttling cable access nut (16) comprised by the manifold cover assembly, where present, is disposed to retain the adjusting tunnel barrier (18) and intermediate securing means (19) in place. Its (16) precise disposition is at the barrier's (18) pivot point, to which it is axial. The intermediate securing means (19) is also similarly axially disposed thereat. The disposition of the nut (16) must provide a firm connection but, nevertheless, allow sufficient play to operably pivot the tunnel barrier (18).

The throttling cable access nut (16) comprises a tubular interior (21) configured to allow the throttling cable (500) to pass through it (21). The tubular interior (21) may, therefore, be considered to comprise a continuation of the gate spring receiving tunnel (504), with which it (510) is aligned. As described supra, the cable (500) continues on through the coiled gate spring (550) in the gate spring receiving tunnel (504) and then through the tunnel floor slot (508), terminating in the cable end trap (509), supra The cable sheath (501) accompanying the cable (500) is allowed to enter the nut's tubular interior (21) but terminate therein, where it (501) is anchored by attachment means known to prior art. Preferably, the connection is made by threaded conduit within the nut into which the sheath (501) is interthreaded.

The manifold cover assembly additionally comprises a gate spring stabilizing pin (17) disposed to extend within the coiled gate spring (550). Since the spring (550) is braced against the manifold cover (15) in its contracted state when the throttling gate (41) is raised by the retracted throttling cable (500), the stabilizing pin (17) is conveniently disposed to fill a substantial portion of the coiled spring's (550) interior. Because the throttling cable (500) must be strung through the spring (550), however, the stabilizing pin (17), like the access nut (16) comprising it (17), must be configured so that the nut's (16) tubular interior also passes through it (17).

The subject matter of this application comprises inventive material independent from but conjoined with substantial portions of prior art. While no attempt is made herein to claim those prior art constructions, they are described in sufficient detail to reveal their interrelationship with the novel features hereof.

The inventor hereby claims:

1. An improved performance carburetor comprising:

a sculpted chamber comprising D-shaped configuration;

a carburetion adjusting assembly;

a carburetion gate adjusting channel;

a manifold cover assembly;

a needling fuel jet disposed within the chamber;

a carburetor float assembly; and an engine idle tuning assembly;

the carburetion adjusting assembly comprising a throttling gate;

a throttling cable disposed within a cable sheath so as to operably retract therein and effectually open the throttling gate;

a coiled gate spring disposed to expand against and effectually close the throttling gate;

a multiply beveled fuel flow interference needle; and a threaded adjusting block;

is the throttling gate in turn comprising a coil spring tunnel wherein the coil spring is disposed;

a needle advancement and retraction threaded adjusting tunnel wherein the adjusting block is disposed;

an idle tuning screw engagement groove comprising in turn a tuning screw impingement zone;

the sculpted chamber further comprising an intake end and an effluxive end;

the coil spring tunnel comprising throttling cable anchoring means; and an external port;

the needle advancement and retraction adjusting tunnel comprising an internal port; and an external port;

the carburetion gate adjusting channel disposed to allow the throttling gate to slide therein to effectually closed disposition in response to gate spring expansion, thereby reducing cross sectional carburetor airflow access area, or to effectually open disposition in response to throttling cable operable retraction, thereby enlarging the area;

the manifold cover assembly comprising a manifold cover attached to overlie the gate sliding channel and comprising apertures aligned with the external ports of the needle advancement and retraction adjusting tunnel and the coil spring tunnel; and a throttling cable access nut comprising a tubular interior to receive the throttling cable; and attachment means to anchor the throttling cable sheath;

the multiply beveled fuel flow interference needle comprising a multiply beveled projecting shank disposed in extension from the throttling gate's interior tunnel port; and a needle stop disposed within the needle advancement and retraction adjusting tunnel;

the threaded adjusting block comprising adjustable turning means disposed for operable access from the tunnel's external port; and spring loaded block lugs, each disposed upon operable adjustment of the threaded block to align with and become seated within a detent.

2. The improved performance carburetor according to claim 1 further comprising a separation seam dividing the carburetor into a frontal chamber complement disposed proximate the effluxive chamber end and a rear chamber complement disposed proximate the intake chamber end.

3. The improved performance carburetor according to claim 1 further comprising pressure equalizing vents and vent tubing disposed to provide the carburetor float assembly with air comprising atmospheric pressure.

4. The improved performance carburetor according to claim 1 wherein the throttling cable comprises a knurled end and the coil spring tunnel's throttling cable anchoring means comprises a throttling cable end trap, the throttling cable disposed to extend the trap through a slot disposed in the tunnel floor.

5. The improved performance carburetor according to claim 1 wherein the multiply beveled fuel flow interference needle further comprises a spring collar disposed in the needle advancement and retraction adjusting tunnel and the adjusting assembly further comprises a spacing spring disposed to enwrap the collar therein.

6. The improved performance carburetor according to claim 1 wherein the threaded adjusting block comprises one or more detents each disposed circumferentially at fractional turn intervals thereon;

spring loaded block lugs disposed within the needle advancement and retraction adjusting tunnel so as to engage the detents; and means to retain the block lugs in place within the tunnel.

7. The improved performance carburetor according to claim 6 wherein the number of detents and lugs comprises four such that the fraction representing the turn intervals equals one-fourth.

8. The improved performance carburetor according to claim 6 wherein the means to retain the block lugs in place within the tunnel comprises a set screw comprising a slotted head.

9. The improved performance carburetor according to claim 1 wherein the manifold cover assembly further comprises a pivotable adjusting tunnel barrier; and intermediate barrier securing means disposed to overlie the barrier, both barrier and securing means retained in place by the rigidly emplaced throttling cable access nut.

10. The improved performance carburetor according to claim 9 wherein the intermediate barrier securing means comprises a compression washer.

11. The improved performance carburetor according to claim 1 wherein the throttling cable access nut comprises a gate spring stabilizing pin disposed to extend within the coil gate spring;

and the means to anchor the throttling cable sheath comprises a threaded conduit within the cable access nut wherein the sheath is interthreaded.

12. The improved performance carburetor according to claim 1 wherein the number of bevels disposed on the projecting shank comprised by fuel flow interference needle equals three.

13. The improved performance carburetor according to claim 1 wherein the needling jet is disposed at the bottom of the chamber in the rear complement thereof.

14. The improved performance carburetor according to claim 2 comprising an adjustable auxiliary fuel jet disposed at the top of the chamber in the frontal complement thereof, comprising in turn an auxiliary jet tube comprising an emission aperture disposed at a central aperture emission site within the chamber; and an adjustment screw;

and the carburetor further comprising vent tubing connecting the carburetion float assembly with the auxiliary fuel jet;

whereby fuel may be transferred from the float assembly to the jet.

* * * * *